US008707924B2

(12) United States Patent
Moriya

(10) Patent No.: US 8,707,924 B2
(45) Date of Patent: Apr. 29, 2014

(54) CONTROL DEVICE AND CONTROL METHOD FOR ENGINE, ENGINE STARTING DEVICE, AND VEHICLE

(75) Inventor: Kouki Moriya, Aichi-gun (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 0 days.

(21) Appl. No.: 13/807,184

(22) PCT Filed: Mar. 8, 2011

(86) PCT No.: PCT/JP2011/055330

§ 371 (c)(1),
(2), (4) Date: Dec. 27, 2012

(87) PCT Pub. No.: WO2012/120632

PCT Pub. Date: Sep. 13, 2012

(65) Prior Publication Data

US 2013/0103289 A1 Apr. 25, 2013

(51) Int. Cl.
*F02N 11/08* (2006.01)

(52) U.S. Cl.
USPC ..... 123/179.4; 123/179.3; 123/179.25; 701/110; 701/112; 701/113

(58) Field of Classification Search
USPC ..... 701/113; 123/179.1, 179.3, 179.4, 123/185.1, 185.14, 185.5, 185.6
See application file for complete search history.

(56) References Cited

U.S. PATENT DOCUMENTS

| | | | | |
|---|---|---|---|---|
| 6,499,342 | B1 * | 12/2002 | Gonzales, Jr. | 73/114.26 |
| 6,612,296 | B1 * | 9/2003 | Yonezawa et al. | 123/612 |
| 6,907,342 | B1 * | 6/2005 | Matsuoka | 701/113 |
| 8,299,639 | B2 * | 10/2012 | Usami et al. | 290/38 R |
| 8,573,174 | B2 * | 11/2013 | Moriya et al. | 123/179.3 |
| 2002/0007244 | A1 * | 1/2002 | Shimizu | 701/113 |
| 2004/0153235 | A1 | 8/2004 | Kataoka et al. | |
| 2008/0162007 | A1 * | 7/2008 | Ishii et al. | 701/54 |
| 2010/0050970 | A1 | 3/2010 | Okumoto et al. | |

(Continued)

FOREIGN PATENT DOCUMENTS

| | | | |
|---|---|---|---|
| CN | 101865065 | A | 10/2010 |
| DE | 10 2004 004 078 | A1 | 9/2004 |

(Continued)

OTHER PUBLICATIONS

International Preliminary Report on Patentability Issued Sep. 25, 2012 in PCT/JP11/55330 Filed Mar. 8, 2011.

(Continued)

*Primary Examiner* — Stephen K Cronin
*Assistant Examiner* — Carl Staubach
(74) *Attorney, Agent, or Firm* — Oblon, Spivak, McClelland, Maier & Neustadt, L.L.P.

(57) ABSTRACT

An engine is driven by a starter including a pinion gear that can be engaged with a ring gear coupled to a crankshaft; an actuator causing, in a driven state, the pinion gear to be moved to a position where the pinion gear is engaged with the ring gear; and a motor causing the pinion gear to be rotated. The engine is provided with a rotation angle sensor for detecting rotation of the crankshaft. ECU detects the crank angle of the crankshaft based on a signal from the rotation angle sensor after the actuator is driven and the motor is driven.

15 Claims, 6 Drawing Sheets

(56) References Cited

U.S. PATENT DOCUMENTS

| | | | | |
|---|---|---|---|---|
| 2010/0242905 | A1* | 9/2010 | Machida et al. | 123/339.14 |
| 2010/0326389 | A1 | 12/2010 | Okumoto et al. | |
| 2011/0137544 | A1* | 6/2011 | Kawazu et al. | 701/113 |
| 2012/0199090 | A1 | 8/2012 | Kitano et al. | |
| 2012/0312269 | A1* | 12/2012 | Fujiwara et al. | 123/179.4 |

FOREIGN PATENT DOCUMENTS

| | | | | |
|---|---|---|---|---|
| EP | 2 159 410 | | 3/2010 | |
| EP | 2 302 198 | A2 | 3/2011 | |
| EP | 2 302 199 | A2 | 3/2011 | |
| FR | 2 850 427 | | 7/2004 | |
| JP | 2004 232488 | | 8/2004 | |
| JP | 2004332599 | * | 11/2004 | F02D 17/00 |
| JP | 2010 1760 | | 1/2010 | |
| JP | 2010 236533 | | 10/2010 | |
| JP | 2011 94488 | | 5/2011 | |
| WO | 2011/052174 | A1 | 5/2011 | |

OTHER PUBLICATIONS

International Search Report Issued Apr. 26, 2011 in PCT/JP11/55330 Filed Mar. 8, 2011.

International Preliminary Report on Patentability received in corresponding appliication No. PCT/JP2011/055330 on Sep. 25, 2012 (w/ English translation).

* cited by examiner

CONTROL DEVICE AND CONTROL METHOD FOR ENGINE, ENGINE STARTING DEVICE, AND VEHICLE

TECHNICAL FIELD

The present invention relates to a control device for an engine, a control method for an engine, an engine starting device, and a vehicle, and more particularly to control for preventing erroneous recognition of a crank angle at the time of startup of the engine.

BACKGROUND ART

For the purpose of reducing fuel consumption and exhaust emissions in vehicles incorporating an internal combustion engine or the like as the engine, some vehicles are mounted with the so-called idling stop or economic running function directed to automatically stopping the engine when the vehicle has stopped and the brake pedal is manipulated by the driver, and automatically starting the engine again in response to a restarting operation made by the driver such as reducing the operated amount of the brake level to zero.

Furthermore, some starters for starting the engine can drive individually the engagement mechanism for engaging the pinion gear of the starter with the ring gear of the engine and a motor for rotating the pinion gear. Also, at the startup of the engine, the engine may be cranked up by the motor after engaging the pinion gear and the ring gear with each other.

Furthermore, some starters for starting the engine can drive individually the engagement mechanism for engaging the pinion gear of the starter with the ring gear of the engine and a motor for rotating the pinion gear.

EP 2159410A (PTL 1) discloses a configuration of controlling the starter of an engine that can control individually a pinion gear and a motor for rotating the pinion gear by switching, when the engine is to be restarted after the engine has been stopped, between a mode in which the pinion gear is driven before the motor and a mode in which, previous to the motor, the pinion gear is driven, in accordance with the engine rotational speed.

CITATION LIST

Patent Literature

PTL 1: EP 2159410A

SUMMARY OF INVENTION

Technical Problem

In the control device controlling the engine, since the valve opening/closing timing and the ignition timing are controlled by the rotation angle of the crankshaft (crank angle), the engine is generally provided with a rotation angle sensor for detecting the rotation of the crankshaft.

As described above, at the startup of the engine, when using such a method that the pinion gear of the starter is engaged with the ring gear of the engine and the motor of the starter is then driven to rotate the crankshaft, noise may be produced in the signal from the rotation angle sensor by minute vibration produced when the pinion gear and the ring gear are engaged with each other, depending on the position where the crankshaft is stopped while the engine is stopped.

When such noise occurs, it is recognized in calculation of the crank angle in the control device as if the crankshaft is rotated due to noise even though the crankshaft is actually not rotated. Accordingly, the crank angle recognized by the control device may be displaced from the actual crank angle.

In this case, in engine control executed by the control device, the control timing for opening/closing of the valve, ignition and the like may be displaced from the appropriate timing, which may deteriorate the combustion efficiency and the gas emission characteristics.

The present invention has been made to solve the above-described problems, and an object of the present invention is to prevent erroneous recognition of the crank angle resulting from noise produced in the rotation angle sensor at the startup of the engine.

Solution to Problem

A control device for an engine according to the present invention serves as a control device for an engine provided with a starter including a second gear that can be engaged with a first gear coupled to a crankshaft; an actuator causing, in a driven state, the second gear to be moved to a position where the second gear is engaged with the first gear; and a motor causing the second gear to be rotated. The engine is provided with a detection unit for detecting rotation of the crankshaft. The control device updates a value of a crank angle of the crankshaft recognized by the control device based on a signal from the detection unit after the actuator is driven and the motor is driven.

Preferably, the control device limits update of the value of the crank angle based on the signal from the detection unit during a time period from a time when the actuator is driven until a time when the motor is driven.

Preferably, the actuator and the motor are individually controlled by the control device.

Preferably, the control device drives the motor when noise contained in the signal from the detection unit subsides after starting driving of the actuator.

Preferably, the control device determines that the noise subsides, when a state where the signal from the detection unit does not change continues for a predetermined time period after starting driving of the actuator.

Preferably, the control device outputs a signal for driving the actuator. In the starter, the motor is driven in response to completion of an operation of the actuator.

Preferably, the control device controls the engine based on the updated crank angle.

Preferably, the crankshaft is provided with a detection plate that rotates together with the crankshaft. The detection unit generates a pulse signal by detecting a tooth provided around a periphery of the detection plate. The control device counts the pulse signal generated by the detection unit to update the value of the crank angle of the crankshaft.

An engine starting device according to the present invention includes the starter and the control device described in any of the above.

A control method for an engine according to the present invention is a control method for an engine provided with a starter including a second gear that can be engaged with a first gear coupled to a crankshaft; an actuator causing, in a driven state, the second gear to be moved to a position where the second gear is engaged with the first gear; and a motor causing the second gear to be rotated. The engine is provided with a detection unit for detecting rotation of the crankshaft. The control method includes the steps of: driving the actuator; and updating a value of a crank angle of the crankshaft based on a signal from the detection unit after the actuator is driven and the motor is driven.

A vehicle according to the present invention includes a starter, a detection unit, and a control device for controlling the starter. The starter includes a second gear that can be engaged with a first gear coupled to a crankshaft; an actuator causing, in a driven state, the second gear to be moved to a position where the second gear is engaged with the first gear; and a motor causing the second gear to be rotated. The detection unit detects rotation of the crankshaft. The control device updates a value of a crank angle of the crankshaft recognized by the control device based on a signal from the detection unit after the actuator is driven and the motor is driven.

Advantageous Effects of Invention

According to the present invention, it becomes possible to prevent erroneous recognition of the crank angle resulting from noise produced in the rotation angle sensor at the startup of the engine, thereby allowing deterioration in the combustion efficiency and the gas emission characteristics to be suppressed.

DESCRIPTION OF EMBODIMENTS

Figure 1:
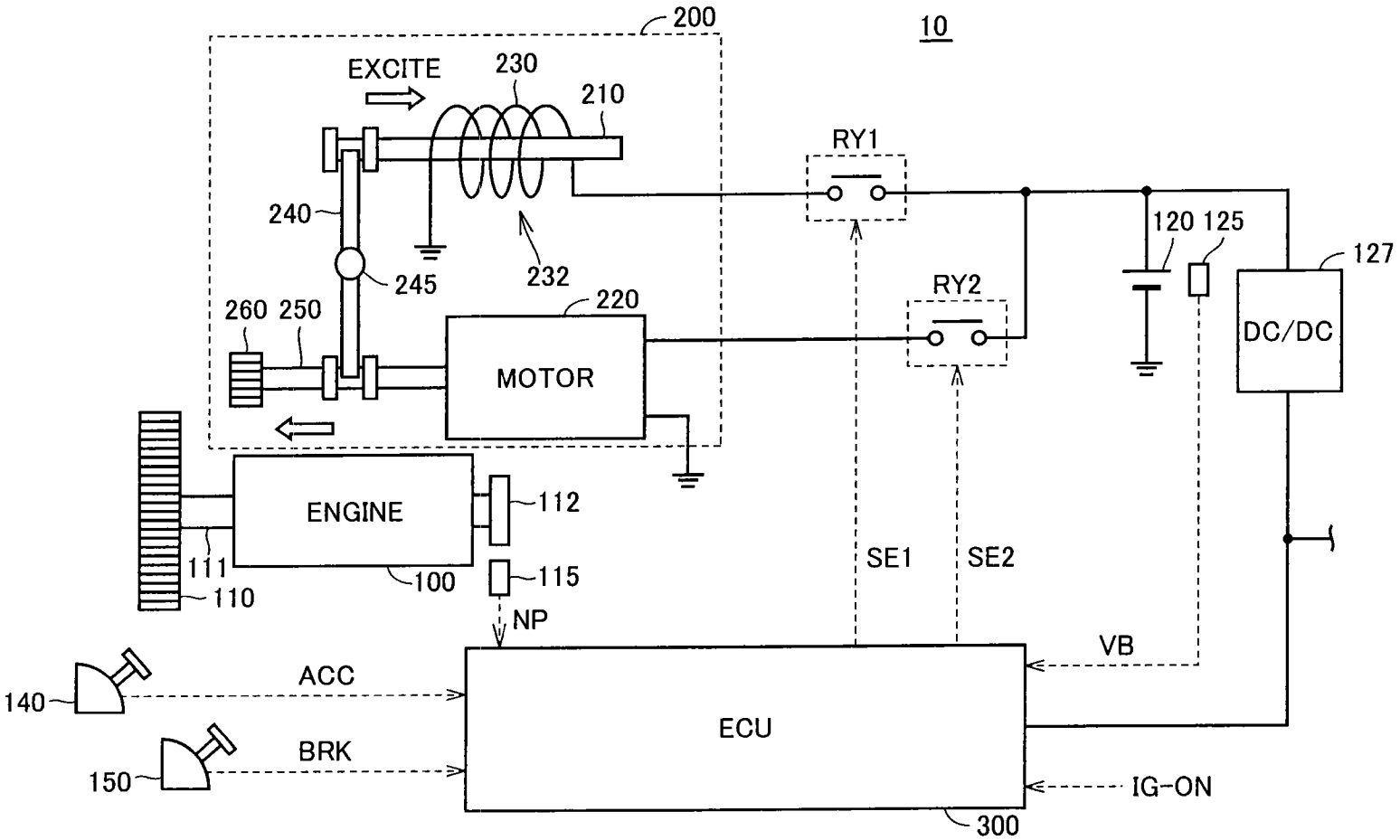
FIG. 1 is an entire block diagram of a vehicle equipped with a control device for an engine according to the first embodiment.

The embodiments of the present invention will be hereinafter described with reference to the accompanying drawings. In the following description, the same components are designated by the same reference characters. Names and functions thereof are also the same. Accordingly, the detailed description thereof will not be repeated.

First Embodiment

FIG. 1 is an entire block diagram of a vehicle 10 equipped with a control device for an engine according to the first embodiment. Referring to FIG. 1, vehicle 10 includes an engine 100, a battery 120, a starter 200, a control device (which will be hereinafter also referred to as an ECU (Electronic Control Unit)) 300, and relays RY1 and RY2. Starter 200 includes a plunger 210, a motor 220, a solenoid 230, a connector 240, an output member 250, and a pinion gear 260.

Engine 100 generates a motive force to cause vehicle 10 to run. A crankshaft 111 of engine 100 is connected to a driving wheel via a power transmission device that includes a clutch, a reduction gear, and the like.

A rotation angle sensor 115 is provided at engine 100. Rotation angle sensor 115 detects an edge of the tooth provided around the periphery of a sensor plate 112 that rotates together with crankshaft 111. Then, rotation angle sensor 115 generates a pulse signal NP corresponding to detection of the tooth of sensor plate 112, and outputs the signal to ECU 300.

Battery 120 is a chargeable and dischargeable electric power storage component. Battery 120 is formed to include a secondary battery such as a lithium-ion battery, a nickel-metal hydride battery or a lead acid battery. Battery 120 may also be formed of a power storage element such as an electric double layer capacitor.

Battery 120 is connected to starter 200 via relays RY1 and RY2 under control of ECU 300. Battery 120 supplies the power supply voltage for driving to starter 200 by closing relays RY1 and RY2. The negative electrode of battery 120 is connected to body earth.

Battery 120 is provided with a voltage sensor 125. Voltage sensor 125 detects an output voltage VB of battery 120 and outputs the detected value to ECU 300.

The voltage of battery 120 is supplied to ECU 300 as well as to auxiliary equipment such as the inverter of an air conditioner or the like via a DC/DC converter 127.

Relay RY1 has one end connected to the positive electrode of battery 120 and the other end connected to one end of solenoid 230 in starter 200. Relay RY1 is controlled by a control signal SE1 from ECU 300 to switch between supplying and cutting-off of the power supply voltage from battery 120 to solenoid 230.

Relay RY2 has one end connected to the positive electrode of battery 120 and the other end connected to motor 220 in starter 200. Relay RY2 is controlled by a control signal SE2 from ECU 300 to switch between supplying and cutting-off of the power supply voltage to motor 220 from battery 120.

The supply of the power supply voltage to motor 220 and solenoid 230 in starter 200 can be controlled independently by relays RY2 and RY1, respectively.

Output member 250 is coupled with a rotational shaft of a rotor (not shown) in the motor through, for example, a linear spline or the like. Further, pinion gear 260 is provided at an end of output member 250 at the side opposite to motor 220. When the power supply voltage is supplied from battery 120 by closing relay RY2 to cause rotation of motor 220, output member 250 transmits the rotational operation of the rotor to pinion gear 260 for rotation thereof.

As mentioned above, solenoid 230 has one end connected to relay RY1 and the other end connected to the body earth. When relay RY1 is closed to excite solenoid 230, solenoid 230 draws plunger 210 in the direction of the arrow. Namely, plunger 210 and solenoid 230 constitute an actuator 232.

Plunger 210 is coupled with output member 250 via connector 240. Solenoid 230 is excited to draw plunger 210 in the direction of the arrow. Accordingly, output member 250 is moved by connector 240 having a fixed fulcrum 245 from the standby position shown in FIG. 1 in the direction opposite to the moving direction of plunger 210, i.e. in the direction of pinion gear 260 moving farther away from the body of motor 220. Plunger 210 is biased by a force in a direction opposite to that of the arrow in FIG. 1 by a spring mechanism not shown, and returns to the standby position when solenoid 230 attains a non-excited state.

By the movement of output member 250 in the axial direction by the excitation of solenoid 230, pinion gear 260 engages with a ring gear 110 provided at the outer circumference of a flywheel or drive plate attached to crankshaft 111 of engine 100. By the rotational motion of pinion gear 260 in the state engaged with ring gear 110, engine 100 is cranked up to start engine 100.

According to the first embodiment, actuator 232 that moves pinion gear 260 to engage with ring gear 110 provided at the outer circumference of a flywheel or drive plate of engine 100 and motor 220 that rotates pinion gear 260 are controlled individually.

Although not shown in FIG. 1, a one-way clutch may be provided between output member 250 and the rotor shaft of motor 220 to prevent the rotor of motor 220 from rotating by the rotational motion of ring gear 110.

Actuator 232 shown in FIG. 1 is not limited to the above-described mechanism as long as the rotation of pinion gear 260 can be transmitted to ring gear 110 and switching is allowed between an engaged state and non-engaged state of pinion gear 260 with ring gear 110. For example, a mechanism may be employed in which engagement between pinion gear 260 and ring gear 110 is established by moving the shaft of output member 250 in the radial direction of pinion gear 260.

Although not shown, ECU 300 includes a CPU (Central Processing Unit), a storage unit, and an input/output buffer to receive the inputs from each sensor and to provide a control command to each device. The control thereof is not limited to processing by software, and a portion thereof may be processed by developing dedicated hardware (electronic circuit).

ECU 300 receives a signal ACC representing the operation amount of an accelerator pedal 140 from a sensor (not shown) provided at accelerator pedal 140. ECU 300 receives a signal BRK representing the operation amount of a brake pedal 150 from a sensor (not shown) provided at brake pedal 150. ECU 300 also receives a start operation signal IG-ON by an ignition operation or the like conducted by the driver. ECU 300 generates a start request signal or stop request signal of engine 100 based on such information, and outputs control signals SE1 and SE2 according to the generated signals to control the operation of starter 200.

For example, when the stop condition of the vehicle being stopped and brake pedal 150 being operated by the driver is established, a stop request signal is generated and ECU 300 stops engine 100. In other words, when the stop condition is established, the fuel injection and combustion at engine 100 are stopped.

At a later time, when the starting condition of the operation amount of brake pedal 150 by the driver to attain zero is established, a start request signal is generated and ECU 300 drives motor 220 to start engine 100. Alternatively, engine 100 may be started in response to an operation of accelerator pedal 140, a shift lever to select the transmission range or gear, or a switch to select a vehicle running mode (for example, power mode or economic mode, or the like).

Generally, the value of the crank angle of engine 100 in ECU 300 may be updated by detecting an edge of a tooth in gear wheel-shaped sensor plate 112 provided in crankshaft 111, for example, using rotation angle sensor 115 such as a distance sensor, and by counting pulse signals generated by the edges using ECU 300. Alternatively, although not shown, a sensor plate having a slit-shaped hole provided in the circumferential direction may be used to detect light passing through the slit, thereby generating a pulse signal similar to that as described above.

In such a configuration, when starter 200 is started in order to start engine 100 to cause pinion gear 260 to be engaged with or brought into contact with ring gear 110, contact between pinion gear 260 and ring gear 110 may cause crankshaft 111 to undergo minute vibration in the rotation direction.

Figure 2:
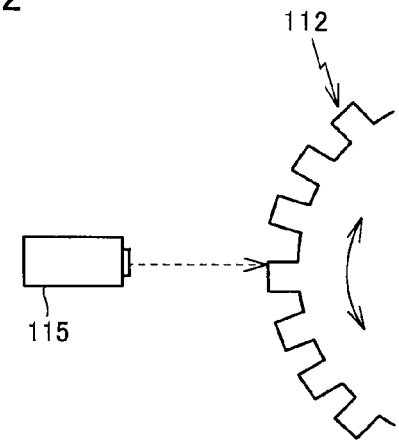
FIG. 2 is a diagram for illustrating problems in detecting a crank angle.

In this case, as shown in FIG. 2, when the engine is stopped in the state where rotation angle sensor 115 has detected a portion in close proximity to the edge of the tooth of sensor plate 112, rotation angle sensor 115 may detect the same edge of the tooth more than once due to this minute vibration of crankshaft 111. This may cause erroneous recognition in ECU 300 that the crank angle is rotated, due to noise of a plurality of pulse signals that are caused by rotation angle sensor 115 detecting the same edge of the tooth more than once.

Based on the crank angle, ECU 300 controls the timing of opening/closing the intake and exhaust valves, the fuel injection timing, the ignition timing, and the like in engine 100. Accordingly, when this crank angle is erroneously recognized, appropriate engine control cannot be performed, which may cause deterioration in the engine efficiency and the gas emission characteristics.

Thus, in the first embodiment, the starter drive control is performed as described below to prevent erroneous recognition of the crank angle that may occur at the time of startup of the engine.

Figure 3:
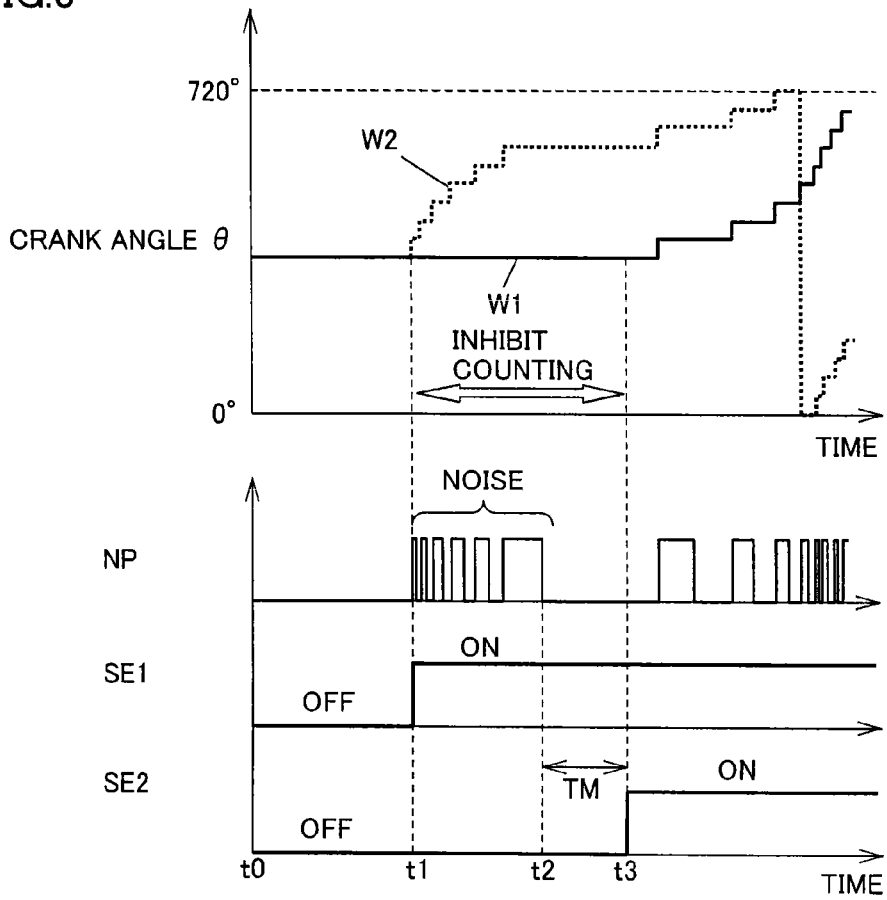
FIG. 3 is a time chart for illustrating the outline of starter drive control according to the first embodiment.

FIG. 3 is a time chart for illustrating the outline of starter drive control according to the first embodiment. In FIG. 3, the horizontal axis shows time while the vertical axis shows states of each of a crank angle θ, pulse signal NP from rotation angle sensor 115, and control signals SE1 and SE2 for driving relays RY1 and RY2, respectively.

Referring to FIGS. 1 and 3, the case where no noise occurs in pulse signal NP will be first hereinafter described.

At time t1, when start operation signal IG-ON produced by driver's ignition operation and the like is received, control signal SE1 is turned ON to cause actuator 232 to be driven. Then, at time t3 after a lapse of a prescribed time period during which the operation of plunger 210 of actuator 232 is completed, control signal SE2 is turned ON to cause motor 220 to be driven. This causes crankshaft 111 to be rotated, and then, pulse signal NP from rotation angle sensor 115 is input.

ECU 300 counts this pulse signal NP, thereby updating the value of crank angle θ (line W1 in FIG. 3).

On the other hand, in the case where the engine is stopped in the state where rotation angle sensor 115 has detected a portion in close proximity to the edge of the tooth of sensor plate 112, and noise occurs in pulse signal NP due to vibration caused by engagement or contact between pinion gear 260 and ring gear 110 when actuator 232 is driven, ECU 300 counts a pulse caused by this noise. This causes the value of crank angle θ to be updated, as shown by a dashed line W2 in FIG. 3, despite that crankshaft 111 does not actually rotate, with the result that the recognized crank angle θ in ECU 300 is to be displaced from the actual position.

In the starter drive control according to the first embodiment, counting of pulse signal NP is inhibited during the time period from the time when driving of actuator 232 is started until the time when driving of motor 220 is started, that is, during the time period from time t1 to time t3 in FIG. 3. Consequently, even when the noise of pulse signal NP as described above is input, the value of crank angle θ is not updated but is maintained, so that erroneous recognition of crank angle θ caused by noise can be prevented.

In addition, inhibition of updating of crank angle θ in ECU 300 described above may be implemented by accepting input of pulse signal NP and not performing the process of updating the value of crank angle θ only during the time period from time t1 to time t3 in FIG. 3, or for example by providing a switch in an input terminal portion through which pulse signal NP is input to ECU 300, to thereby prevent acceptance of input of pulse signal NP itself.

Furthermore, update of the crank angle may be restricted not by completely inhibiting counting of pulse signal NP, but by changing the degree of variation in crank angle θ. Specifically, for example, unlike in the ordinary case where it is recognized that the angle varies by α° in one pulse of pulse signal NP, it may be recognized during the time period from time t1 to time t3 in FIG. 3 that the angle varies by α° in ten pulses, and in this way, the sensitivity of angle variation to the number of pulses of pulse signal NP may be decreased.

Furthermore, in the first embodiment, when the noise of pulse signal NP as described above is detected in the state where actuator 232 is driven but motor 220 is not driven, motor 220 is prevented from being driven until it is detected that crankshaft 111 has come into the stabilized state after a lapse of a prescribed time period TM since noise subsided. In this way, it becomes possible to drive the engine after the crank angle is accurately fixed.

Figure 4:
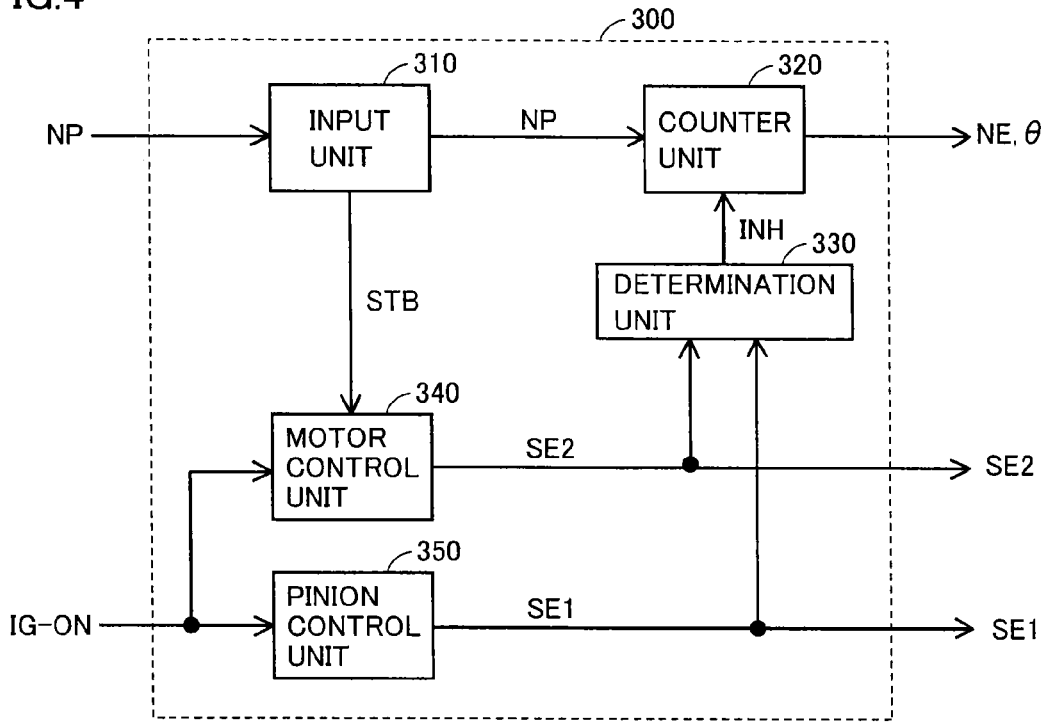
FIG. 4 is a functional block diagram for illustrating the starter drive control executed at an ECU according to the first embodiment.

FIG. 4 is a functional block diagram for illustrating the starter drive control executed at ECU 300 according to the first embodiment. Each functional block shown in the functional block diagram in FIG. 4 is implemented by processing in hardware or software through ECU 300.

Referring to FIGS. 1 and 4, ECU 300 includes an input unit 310, a counter unit 320, a determination unit 330, a motor control unit 340, and a pinion control unit 350.

Input unit 310 receives pulse signal NP from rotation angle sensor 115. Input unit 310 outputs the received pulse signal NP to counter unit 320.

Furthermore, in the state where engine 100 is stopped (for example, the state where an engine drive command is not output), input unit 310 determines whether or not the state of the received pulse signal does not change for a prescribed time period, that is, whether or not the crank angle is stabilized while the engine is stopped. Then, input unit 310 outputs a stable signal STB showing the determination result to motor control unit 340. Specifically, for example, when the state of the received pulse signal does not change during the prescribed time period, it is determined that the crank angle is stabilized, and then, stable signal STB is set to be ON. On the other hand, when it is determined that the crank angle is not stabilized, stable signal STB is set to be OFF.

Counter unit 320 receives pulse signal NP from input unit 310 and an inhibition signal INH from determination unit 330. Inhibition signal INH is a signal showing whether calculation of crank angle θ based on pulse signal NP is permitted or not, as described later. For example, when inhibition signal INH is set to be ON, the value of crank angle θ is not changed even if pulse signal NP is input. On the other hand, when inhibition signal INH is set to be OFF, crank angle θ is increased or decreased in accordance with pulse signal NP, thereby updating the value of crank angle θ.

Counter unit 320 outputs the calculated crank angle θ to the control unit and the like performing other control such as engine control within ECU 300. Furthermore, engine rotation speed NE is calculated by calculating the temporal change of the calculated crank angle.

Pinion control unit 350 receives start operation signal IG-ON produced by user's ignition operation. In addition, when the engine is automatically restarted even without user's operation as in the case of a vehicle having the so-called idling stop function, a hybrid vehicle or the like, start operation signal IG-ON includes an automatic restart command as described above.

Pinion control unit 350 sets control signal SE1 of relay RY1 to be ON in response to start operation signal IG-ON, and outputs the signal to drive actuator 232. Furthermore, pinion control unit 350 outputs control signal SE1 also to determination unit 330.

Motor control unit 340 receives start operation signal IG-ON and stable signal STB from input unit 310. Basically, after a lapse of a prescribed time period from the time when start operation signal IG-ON is turned ON to cause actuator 232 to be driven until the time when the operation of plunger 210 is completed, motor control unit 340 sets control signal SE2 to be ON and outputs the signal to thereby cause motor 220 to be driven.

However, when stable signal STB from input unit 310 is OFF, that is, when the signal from rotation angle sensor 115 changes even though engine 100 is stopped, motor control unit 340 does not output control signal SE2 even after a lapse of the above-described prescribed time period. Then, when noise caused by vibration of the crank angle subsides and stable signal STB from input unit 310 is turned ON, motor control unit 340 sets control signal SE2 to be ON and outputs the signal to start driving of motor 220. Furthermore, motor control unit 340 outputs control signal SE2 also to determination unit 330.

Determination unit 330 receives control signals SE1 and SE2 from pinion control unit 350 and motor control unit 340, respectively. During the time period from the time when driving of actuator 232 is started until the time when driving of motor 220 is started, that is, when control signal SE1 is ON and control signal SE2 is OFF, determination unit 330 sets inhibition signal INH to be ON and outputs the signal to counter unit 320. As described above, in counter unit 320, even if pulse signal NP is received from input unit 310, the crank angle is not calculated while inhibition signal INH is set to be ON.

Then, referring to FIGS. 5 and 6, an explanation will be given with regard to the above-described detailed starter drive control process executed in the first embodiment.

Figure 5:
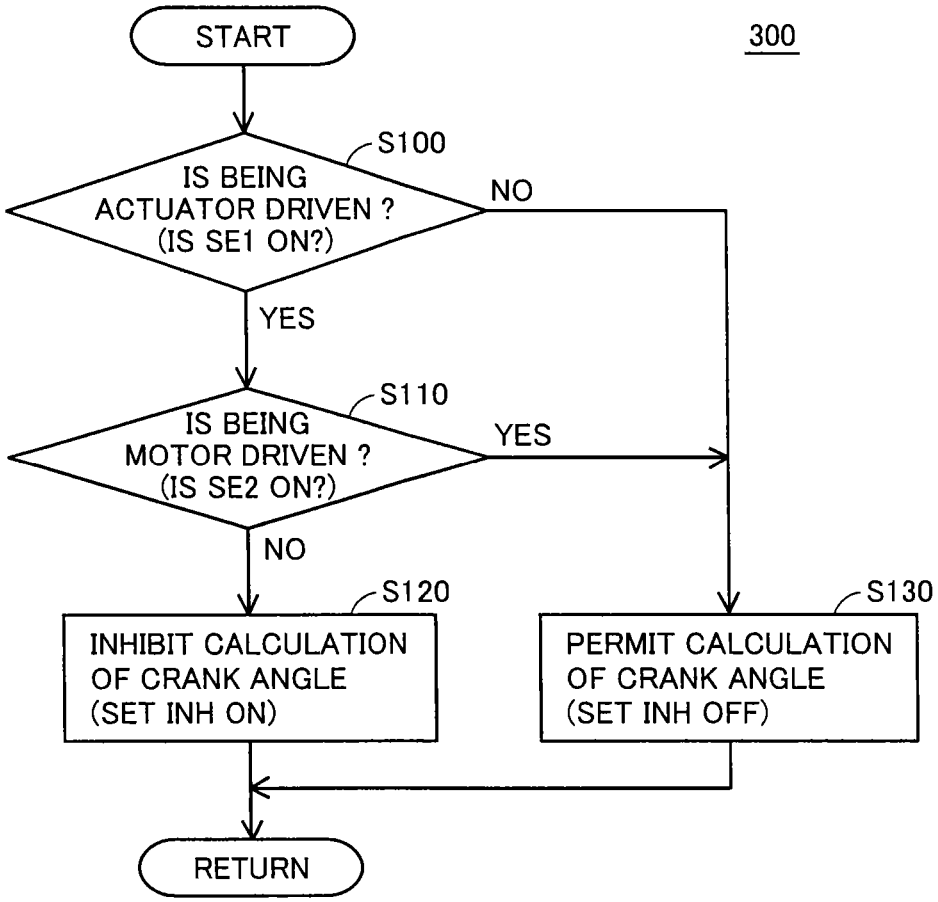
FIG. 5 is a flowchart for illustrating the process executed at the ECU for determining whether a crank angle can be calculated or not, according to the first embodiment.

FIG. 5 is a flowchart for illustrating the process executed at ECU 300 for determining whether a crank angle can be calculated or not, according to the first embodiment. The flowcharts shown in FIG. 5 and FIG. 6 described later are implemented by executing the program stored in ECU 300 in advance in a prescribed cycle. Alternatively, the process may also be implemented for a portion of the steps by developing dedicated hardware (electronic circuit).

Referring to FIGS. 1 and 5, ECU 300 determines in step (which will be hereinafter abbreviated as S) 100 whether or not actuator 232 is being driven, that is, whether or not control signal SE1 is set to be ON.

If actuator 232 is being driven (YES in S100), the process proceeds to S110, in which ECU 300 determines whether or not motor 220 is being driven, that is, whether or not control signal SE2 is ON.

If motor 220 is not being driven (NO in S110), ECU 300 determines that, as in the time period from time t1 to time t3 in FIG. 3, there is a possibility that a noise signal occurs in the output of rotation angle sensor 115 due to contact between pinion gear 260 and ring gear 110. Then, ECU 300 sets inhibition signal INH to be ON so as to inhibit calculation of crank angle θ in S120.

On the other hand, if actuator 232 is not being driven (NO in S100), or if motor 220 is being driven (YES in S110), it is recognized that pinion gear 260 and ring gear 110 are not in contact with each other, or pinion gear 260 and ring gear 110 have already been engaged with each other and engine 100 is cranked up. Accordingly, ECU 300 determines that erroneous recognition of the crank angle by a noise signal is less likely to occur, and then sets inhibition signal INH to be OFF. This allows calculation of the crank angle to be permitted.

Figure 6:
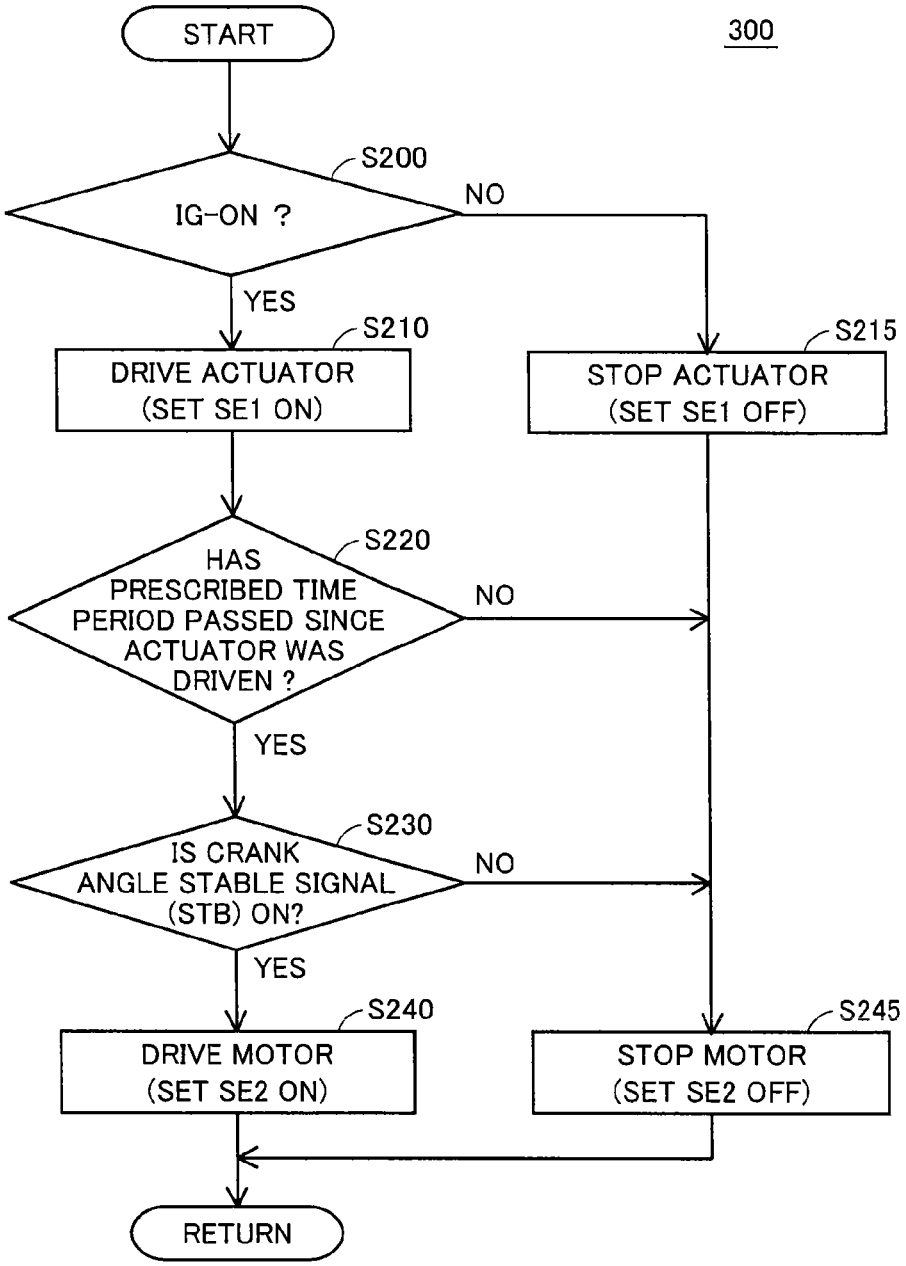
FIG. 6 is a flowchart for illustrating a starter drive control process executed at the ECU according to the first embodiment.

FIG. 6 is a flowchart for illustrating the starter drive control process executed at ECU 300 according to the first embodiment.

Referring to FIGS. 1 and 6, ECU 300 determines in S200 whether or not start operation signal IG-ON has been received.

If start operation signal IG-ON has not been received (NO in S200), it is recognized that startup of engine 100 is not requested, or startup of engine 100 has already been completed. Accordingly, ECU 300 proceeds the process to S215, to stop driving of actuator 232 (that is, set control signal SE1 to be OFF), and further proceeds the process to S245, to stop driving of motor 220 (set control signal SE2 to be OFF).

If start operation signal IG-ON has been received (YES in S200), the process proceeds to S210, in which ECU 300 drives actuator 232 (that is, sets control signal SE1 to be ON) in order to start engine 100. Then, ECU 300 determines in S220 whether or not a predetermined time period has passed since driving of actuator 232 was started. This predetermined time period is determined, as described above, based on the time period from the time when the operation of plunger 210 is started until the time when this operation is completed. The predetermined time period may be a fixed time period, or for example, may be set to be variable in accordance with the output voltage of battery 120 for supplying electric power for driving actuator 232.

If the predetermined time period has passed since driving of actuator 232 was started (YES in S220), the process proceeds to S230, in which ECU 300 determines whether or not stable signal STB is in an ON state, that is, whether or not vibration of the crank angle subsides and the state of pulse signal NP from rotation angle sensor 115 is stabilized.

If stable signal STB is in the ON state (YES in S230), ECU 300 determines that crankshaft 111 is stabilized after pinion gear 260 is engaged with or brought into contact with ring gear 110. Then, ECU 300 proceeds the process to S240, and sets control signal SE2 to be ON, thereby driving motor 220.

On the other hand, if the predetermined time period has not passed since driving of actuator 232 was started (NO in S220), it is recognized that plunger 210 of actuator 232 is in the middle of the operation. Accordingly, control signal SE2 is maintained in the OFF state so as to maintain motor 220 in the stopped state.

Furthermore, if stable signal STB is in an OFF state (NO in S230), ECU 300 determines that pinion gear 260 is in contact with ring gear 110 to cause vibration in crankshaft 111. Accordingly, if motor 220 is kept driven in this manner, pinion gear 260 and ring gear 110 cannot be appropriately engaged with each other, and also, the contact noise between pinion gear 260 and ring gear 110 may be increased. Therefore, ECU 300 proceeds the process to S245, to maintain motor 220 in the stopped state.

By control performed in accordance with the process as described above, calculation of the crank angle is inhibited in the case where there is a noise signal from the rotation angle sensor caused by vibration of the crankshaft. Consequently, erroneous recognition of the crank angle resulting from the noise signal is prevented. Furthermore, since driving of the motor is inhibited while vibration occurs in the crankshaft, it becomes possible to prevent acceleration of wear, increase in noise and the like caused by driving the motor in the state where the pinion gear and the ring gear are not appropriately engaged with each other.

Second Embodiment

In the above description, the case where the starter can control the actuator and the motor individually has been explained.

However, the starter drive control described in the first embodiment is applicable also to such a type of the starter in which only driving of the actuator can be controlled by the ECU, and the motor is driven in response to completion of driving of the actuator.

Figure 7:
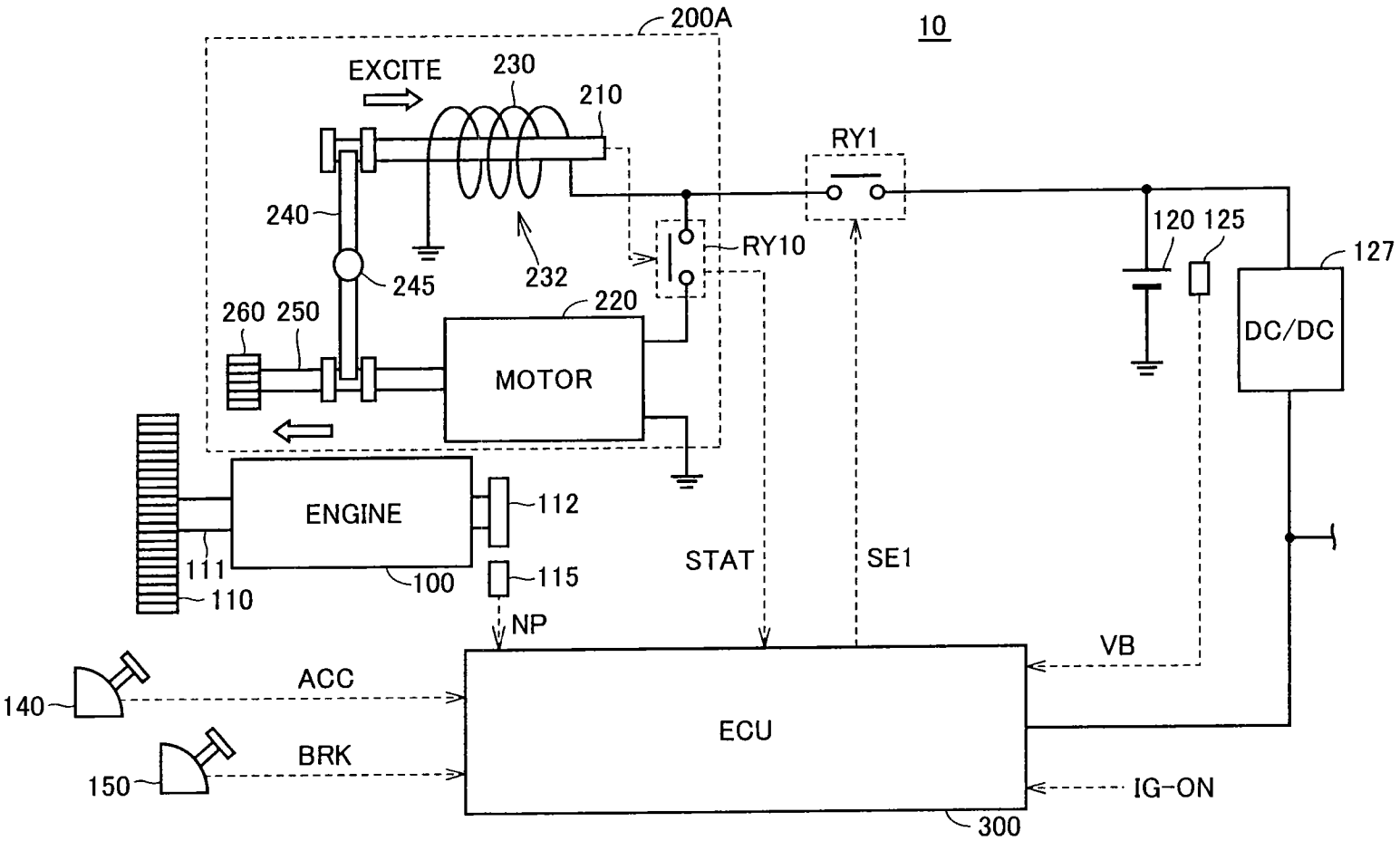
FIG. 7 is an entire block diagram of a vehicle equipped with a control device for an engine according to the second embodiment.

FIG. 7 is an entire block diagram of a vehicle 10 equipped with a control device for an engine according to the second embodiment. In FIG. 7, relay RY2 for driving motor 220 in FIG. 1 is deleted, and a relay RY10 is provided instead within a starter 200A. The same elements as those in FIG. 1 will not be repeated in FIG. 7.

Referring to FIG. 7, relay RY10 has one end connected to the connection node between relay RY1 for driving actuator 232 and solenoid 230, and the other end connected to a power supply input terminal of motor 220.

In response to completion of the operation of plunger 210 to the operation end by solenoid 230 of actuator 232 being excited, relay RY10 is mechanically or electrically closed at its contact. Consequently, the drive electric power is supplied to motor 220 to cause motor 220 to be driven. At this time, relay RY10 outputs a signal STAT showing the opened/closed state of the contact to ECU 300.

In starter 200A configured as described above, since the timing of driving motor 220 depends on the operation of actuator 232, the operation of actuator 232 and the operation of motor 220 cannot be controlled independently, unlike in starter 200 in FIG. 1.

However, even in the case of starter 200A configured as described above, erroneous recognition of the crank angle may occur in the similar way as described above by the noise signal from rotation angle sensor 115 that is produced by vibration occurring when pinion gear 260 is engaged with or brought into contact with ring gear 110 during driving of actuator 232.

Accordingly, in the second embodiment, until it is detected by state signal STAT from relay RY10 that relay RY10 has been closed since driving of actuator 232 was started (that is, after control signal SE1 is set to be ON), ECU 300 maintains the value of the crank angle at a value obtained before driving of actuator 232, and inhibits calculation of the crank angle by the signal from rotation angle sensor 115. In this way, as in the first embodiment, it becomes possible to prevent erroneous recognition of the crank angle caused by the noise signal from rotation angle sensor 115 that is produced by vibration occurring when pinion gear 260 is engaged with or brought into contact with ring gear 110.

It should be understood that the embodiments disclosed herein are illustrative and non-restrictive in every respect. The scope of the present invention is defined by the terms of the claims, rather than the description above, and is intended to include any modifications within the scope and meaning equivalent to the terms of the claims.

REFERENCE SIGNS LIST

10 vehicle, 100 engine, 110 ring gear, 111 crankshaft, 112 sensor plate, 115 rotation angle sensor, 120 battery, 125 voltage sensor, 127 DC/DC converter, 140 accelerator pedal, 150 brake pedal, 200, 200A starter, 210 plunger, 220 motor, 230 solenoid, 232 actuator, 240 connector, 245 fulcrum, 250 output member, 260 pinion gear, 300 ECU, 310 input unit, 320 counter unit, 330 determination unit, 340 motor control unit, 350 pinion control unit, RY1, RY2, RY10 relay.

The invention claimed is:

1. A control device for an engine provided with a starter including a second gear that can be engaged with a first gear coupled to a crankshaft; an actuator causing, in a driven state, said second gear to be moved to a position where said second gear is engaged with said first gear; and a motor causing said second gear to be rotated, said engine being provided with a detection unit for detecting rotation of said crankshaft, said control device being configured to determine whether said actuator is driven, determine whether said motor is driven, update a value of a crank angle of said crankshaft recognized by said control device based on a signal from said detection unit when said control device determines that said actuator is driven and said motor is driven, and inhibit update of the value of the crank angle based on the signal from said detection unit when said control device determines that said actuator is driven and said motor is not driven, wherein said control device inhibits update of the value of the crank angle during a time period from a time when said control device determines that said actuator is driven and said motor is not driven until a time when said actuator is driven and said motor is driven.

2. The control device for an engine according to claim 1, wherein said actuator and said motor are individually controlled by said control device.

3. The control device for an engine according to claim 2, wherein said control device drives said motor when noise contained in the signal from said detection unit subsides after starting driving of said actuator.

4. The control device for an engine according to claim 3, wherein said control device determines that said noise subsides, when a state where the signal from said detection unit does not change continues for a predetermined time period after starting driving of said actuator.

5. The control device for an engine according to claim 1, wherein said control device outputs a signal for driving said actuator, and in said starter, said motor is driven in response to completion of an operation of said actuator.

6. The control device for an engine according to claim 1, wherein said control device controls said engine based on the updated value of the crank angle.

7. The control device for an engine according to claim 1, wherein said crankshaft is provided with a detection plate that rotates together with said crankshaft, said detection unit generates a pulse signal by detecting a tooth provided around a periphery of said detection plate, and said control device counts said pulse signal generated by said detection unit to update the value of the crank angle of said crankshaft.

8. A control method for an engine provided with a starter including a second gear that can be engaged with a first gear coupled to a crankshaft; an actuator causing, in a driven state, said second gear to be moved to a position where said second gear is engaged with said first gear; and a motor causing said second gear to be rotated, said engine being provided with a detection unit for detecting rotation of said crankshaft, said control method comprising:

driving said actuator;

determining whether said motor is driven;

updating a value of a crank angle of said crankshaft based on a signal from said detection unit after said actuator is driven and said motor is determined to be driven; and inhibiting update of the value of the crank angle based on the signal from said detection unit when said actuator is driven and said motor is determined to be not driven, wherein update of the value of the crank angle is inhibited during a time period from a time when said actuator is driven and said motor is determined to be not driven until a time when said actuator is driven and said motor is determined to be driven.

9. A vehicle comprising:

a starter including a second gear that can be engaged with a first gear coupled to a crankshaft, an actuator causing, in a driven state, said second gear to be moved to a position where said second gear is engaged with said first gear, and a motor causing said second gear to be rotated;

a detection unit that detects rotation of said crankshaft; and a control device that controls said starter, wherein said control device updates a value of a crank angle of said crankshaft recognized by said control device based on a signal from said detection unit when said control device determines that said actuator is driven and said motor is driven, said control device inhibits update of the value of the crank angle based on the signal from said detection unit when said control device determines that said actuator is driven and said motor is not driven, said control device inhibits update of the value of the crank angle during a time period from a time when said control device determines that said actuator is driven and said motor is not driven until a time when said actuator is driven and said motor is driven.

10. A control device for an engine provided with a starter including a second gear that can be engaged with a first gear coupled to a crankshaft; an actuator causing, in a driven state, said second gear to be moved to a position where said second gear is engaged with said first gear; and a motor causing said second gear to be rotated, wherein said engine is provided with a detection unit that detects rotation of said crankshaft, said control device obtains and updates a crank angle of said crankshaft detected by said detection unit, said control device inhibits update of the crank angle during a time period from a time when said actuator is driven and said motor is not driven until a time when said actuator is driven and said motor is driven, and updates the crank angle after said actuator is driven and said motor is driven.

11. A control device for an engine provided with a starter including a second gear that can be engaged with a first gear coupled to a crankshaft; an actuator causing, in a driven state, said second gear to be moved to a position where said second gear is engaged with said first gear; and a motor causing said second gear to be rotated, wherein said engine is provided with a detection unit that detects rotation of said crankshaft, said control device obtains and updates a crank angle of said crankshaft detected by said detection unit, said motor is driven after said actuator is driven, said control device inhibits update of the crank angle during a time period from a time when said actuator is driven and said motor is not driven until a time when engagement between said first gear and said second gear is completed and said motor is driven, and updates the crank angle after engagement between said first gear and said second gear is completed and said motor is driven.

12. The control device for an engine according to claim 1, wherein said predetermined time period is fixed.

13. The control device for an engine according to claim 1, wherein said predetermined time period is variable based on an output voltage of a battery which supplies electric power for driving said actuator.

14. The control device for an engine according to claim 1, wherein said control device is configured to update the value of the crank angle when said control device determines that said actuator is not driven.

15. The control device for an engine according to claim 1, wherein said motor is driven after a predetermined time period has passed since said actuator has been started to be driven and said signal from said detection unit is stable.

* * * * *